US009097029B2

(12) United States Patent
Oropallo et al.

(10) Patent No.: US 9,097,029 B2
(45) Date of Patent: Aug. 4, 2015

(54) ICE-COMPENSATING COVER, METHOD OF MANUFACTURE THEREOF, A METHOD OF COVERING A POOL WITH THE ICE-COMPENSATING COVER

(71) Applicants: Anthony N. Oropallo, Southington, CT (US); Wesley C. Clark, Southington, CT (US)

(72) Inventors: Anthony N. Oropallo, Southington, CT (US); Wesley C. Clark, Southington, CT (US)

( * ) Notice: Subject to any disclaimer, the term of this patent is extended or adjusted under 35 U.S.C. 154(b) by 0 days.

(21) Appl. No.: 14/034,377

(22) Filed: Sep. 23, 2013

(65) Prior Publication Data

US 2014/0013500 A1 Jan. 16, 2014

Related U.S. Application Data

(62) Division of application No. 13/023,242, filed on Feb. 8, 2011, now Pat. No. 8,568,546.

(60) Provisional application No. 61/351,107, filed on Jun. 3, 2010.

(51) Int. Cl.
*E04H 4/00* (2006.01)
*E04H 4/10* (2006.01)

(52) U.S. Cl.
CPC ..... *E04H 4/106* (2013.01)

(58) Field of Classification Search
CPC ..... E04H 4/106; E04H 4/10; E04H 4/08
USPC ..... 4/498–503, 506
See application file for complete search history.

(56) References Cited

U.S. PATENT DOCUMENTS

| | | | | |
|---|---|---|---|---|
| 3,366,977 | A | 2/1968 | Koehler | |
| 3,533,110 | A | 10/1970 | Gisondi | |
| 3,676,880 | A | 7/1972 | Kwake | |
| 3,683,428 | A | 8/1972 | Morris | |
| 3,747,131 | A | 7/1973 | Koliomichalis | |
| 3,769,639 | A | 11/1973 | Bishop | |
| 3,801,994 | A | 4/1974 | Brown | |
| 4,000,527 | A | 1/1977 | Gannon | |
| 4,048,678 | A | 9/1977 | Chillino | |
| 4,606,083 | A | 8/1986 | Kingston | |
| 4,685,254 | A | 8/1987 | Terreri | |
| 4,825,479 | A | 5/1989 | Bonneau | |
| 4,847,925 | A * | 7/1989 | Perry | 4/499 |
| 5,144,704 | A | 9/1992 | Genzel et al. | |
| 5,901,503 | A | 5/1999 | Dalene et al. | |
| 6,052,843 | A | 4/2000 | Pirillo | |
| 6,286,157 | B1 | 9/2001 | Baumann | |
| 6,539,559 | B1 | 4/2003 | Creech et al. | |
| 6,694,539 | B1 | 2/2004 | Kordell et al. | |
| 7,350,312 | B1 | 4/2008 | Grillo | |
| 7,874,023 | B1 | 1/2011 | Sundling | |
| 8,015,631 | B2 | 9/2011 | Pesta | |
| 2008/0120771 | A1* | 5/2008 | Rayner | 4/498 |
| 2009/0158517 | A1 | 6/2009 | Herd et al. | |
| 2010/0235979 | A1 | 9/2010 | Pesta | |

* cited by examiner

*Primary Examiner* — Huyen Le
*Assistant Examiner* — Christine Skubinna
(74) *Attorney, Agent, or Firm* — Cantor Colburn LLP

(57) ABSTRACT

An ice-compensating cover including: a cover; a float; and a separable fastener interposed between the cover and the float, the separable fastener including a first portion adhesively bonded to the cover, and a second portion adhesively bonded to the float, wherein at least one of the first portion and the second portion defines a first opening in a center of the at least one of the first portion and the second portion.

12 Claims, 3 Drawing Sheets

ICE-COMPENSATING COVER, METHOD OF MANUFACTURE THEREOF, A METHOD OF COVERING A POOL WITH THE ICE-COMPENSATING COVER

CROSS-REFERENCE TO RELATED APPLICATIONS

This application claims priority to U.S. Provisional Application No. 61/351,107, filed on Jun. 3, 2010, and U.S. patent application Ser. No. 13/023,242, filed on Feb. 8, 2011, the contents of which in their entirety are herein incorporated by reference.

BACKGROUND OF THE INVENTION (1) Field of the Invention

This disclosure relates to an ice-compensating cover for a pool, a method of manufacture thereof, and a method of covering a pool with the ice-compensating cover.

(2) Description of the Related Art

The proper maintenance and protection of swimming pools during the winter months in northern climates has proven to be a problem to swimming pool owners. When water in a pool freezes, forces are generated which can damage the pool because water expands upon freezing. Also, when the ice thaws, portions can break off and damage the cover, pool liner, or pool wall.

Water in a pool provides the pool with structural integrity from the force of the water against the pool walls. Draining a pool can be problematic because of the large volume of water, which must be disposed of. Also, keeping a pool empty throughout the winter months is difficult because of the influx of rain, snow, and debris. Thus most owners elect to allow water to remain in the pool throughout the year.

To avoid damage from water freezing in an above-ground pool, a float is placed in the pool to absorb compressive forces generated by the freezing water. While not wanting to be bound by theory, it is understood that the compressive forces generated by the freezing water are absorbed by compression and/or displacement of the float, thereby relieving stress that would otherwise damage the wall of the pool due to the expansion of water upon freezing.

Use of a float can also be desirable to protect an in-ground pool. In addition to the aforementioned problems, draining of an in-ground pool can create unusual stresses in the wall of the pool caused by the lateral forces of the adjacent earth acting inwardly against the swimming pool's vertical surfaces. With water in the pool, such stresses can be counterbalanced by the forces generated by the retained water. Thus, removal of the water from the pool to prevent freezing can also remove the beneficial effect of the water forces, which normally act outwardly. The unbalanced forces of the weight of earth pressing against the exterior of the pool wall can be sufficient to cause structural damage.

A float is desirably maintained in a center of the pool to provide for even distribution of the ice and the forces generated therefrom. Also, use of a pool cover can also be desirable to prevent the influx of debris or pests, which can result in unsanitary conditions. However, positioning the float and cover on the pool, and maintaining a desirable positioning of the float and cover is difficult. Accordingly, there remains a need for an improved device and method for disposing a float and cover on a pool.

BRIEF SUMMARY OF THE INVENTION

The above described and other drawbacks are alleviated by An ice-compensating cover including: a cover; a float; and a separable fastener interposed between the cover and the float, the separable fastener including a first portion adhesively bonded to the cover, and a second portion adhesively bonded to the float, wherein at least one of the first portion and the second portion defines a first opening in a center of the at least one of the first portion and the second portion.

Disclosed herein too is a method of manufacturing an ice-compensating cover, the method including: adhesively bonding a first portion of a separable fastener to a cover; adhesively bonding a second portion of the separable fastener to a float; and contacting the first portion and the second portion to integrate the first portion with the second portion to manufacture the ice-compensating pool cover, wherein at least one of the first portion and the second portion defines a first opening in a center of the at least one of the first portion and the second portion.

Also disclosed is an ice-compensating cover including: a cover having a first center; a first target disposed on the first center; a float having a second center; a second target disposed on the second center; and a hook and loop fastener interposed between the cover and the float, which includes a first portion including an opening in a center of the first portion, wherein the first portion is adhesively bonded to the cover with a rubber adhesive and the center of the first portion is aligned with the first center, and a second portion including an opening in a center of the second portion, wherein the second portion is adhesively bonded to the float with a rubber adhesive and the center of the second portion is aligned with the second center, wherein the cover is and hook-and-loop fastened to the float.

These and other features, aspects, and advantages of the disclosed embodiments will become better understood with reference to the following description and appended claims.

BRIEF DESCRIPTION OF THE DRAWINGS

The above and other aspects, advantages, and features of this disclosure will become more apparent by describing in further detail exemplary embodiments thereof with reference to the accompanying drawings, in which.

DETAILED DESCRIPTION OF THE INVENTION

Figure 1:
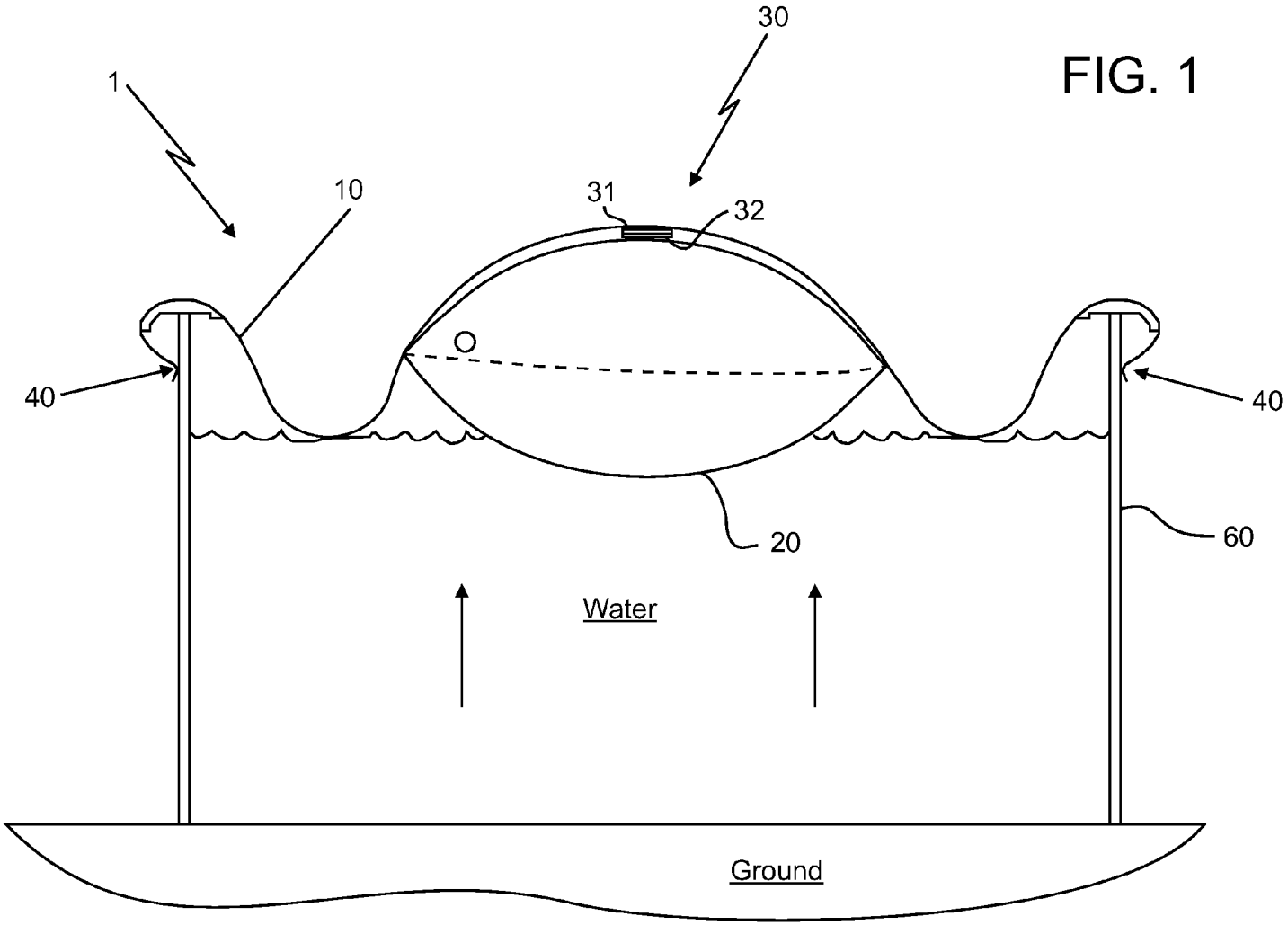
FIG. 1 illustrates an embodiment of an ice-compensating cover on an above-ground pool.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer, or section from another element, component, region, layer or section. Thus, "a first element," "component," "region," "layer," or "section" discussed below could be termed a second element, component, region, layer, or section without departing from the teachings herein.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Spatially relative terms, such as "beneath," "below," "lower," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to plan and/or cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

The disclosed ice-compensating cover can be assembled and disposed on a pool by a single person, thereby facilitating pool maintenance. The disclosed ice-compensating cover also provides for improved centering of the float, thereby reducing the likelihood of winter damage to the pool, and provides improved stabilization of the cover, thereby improving the performance of the cover in windy conditions and lengthening its useful life.

FIG. 1 illustrates an embodiment of an ice-compensating cover 1 comprising a cover 10; a float 20; and a separable fastener 30 interposed between the cover and the float. The separable fastener comprises a first portion 31, which is adhesively bonded to the cover 10, and a second portion 32, which is adhesively bonded to the float. In an embodiment, at least one of the first portion 31 and the second portion 32 defines an opening. In an embodiment, the first portion 31 defines a first opening 33 in a center of first portion 31. Also, the second portion 32 may define a second opening 34 in a center of the second portion 32.

The cover may comprise a polymer, and may comprise a polyolefin such as polyethylene, or polypropylene; polyester; polyamide; polyurethane; a halogen-containing polymer such as polyvinyl chloride, polyvinyl fluoride, vinylidene chloride, vinylidene fluoride, or a copolymer thereof; polyvinyl acetate; a natural polymer; tarpaulin material; or canvas, for example. A combination comprising at least one of the foregoing can be used. In an embodiment the cover is a laminated composite of a plurality of pliable polyethylene sheets. The cover may have dimensions suitable for covering a pool, and may be round or rectilinear.

The float 20 may be inflatable, hollow, comprise a buoyant material, or combination thereof. The float may comprise a polymer such as a polyolefin such as polyethylene; polyurethane; neoprene; silicone; a halogenated polymer such as polyvinyl chloride, vinylidene chloride, vinylidene fluoride, or polyvinyl fluoride; polyvinyl acetate; or a natural polymer such as natural rubber, for example. A combination comprising at least one of the foregoing can be used. In an embodiment an inflatable float comprises edge-bonded sheets of a water impermeable material, such as polyethylene, which are inflated to form an inflatable float. The inflatable float may comprise a valve. The float may comprise a rigid and non-porous material, such as sheet metal, for example. In an embodiment the hollow float is a metal can or a metal barrel, for example. A float comprising a buoyant material may comprise a foam such as neoprene foam, or polyurethane foam, for example. A combination comprising at least one of the foregoing can be used.

Figure 2:
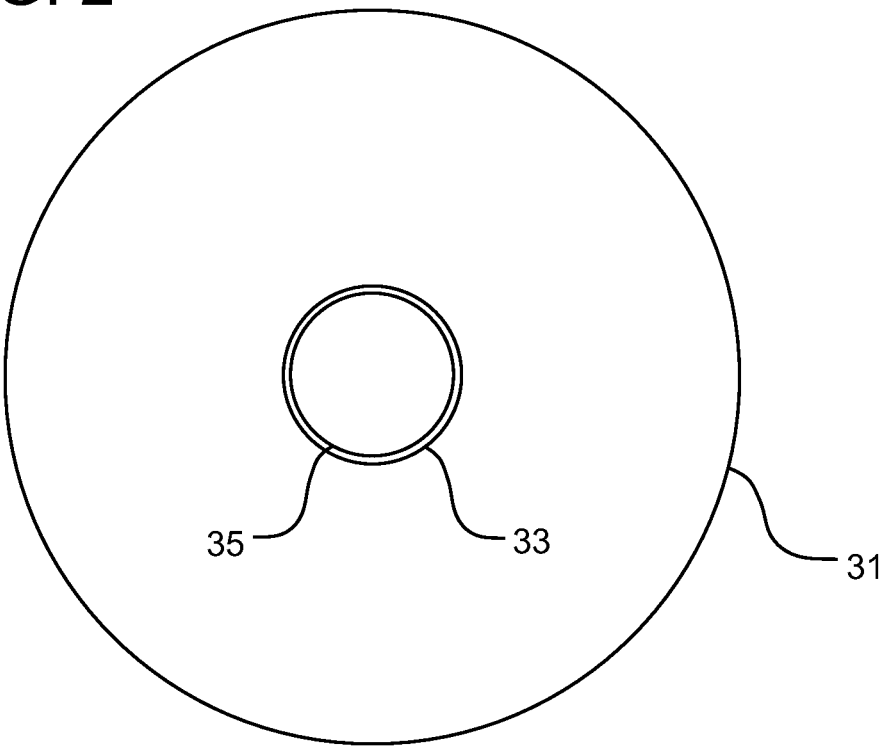
FIG. 2 illustrates an embodiment of a first portion of a hook-and-loop fastener and a first target.
Figure 3:
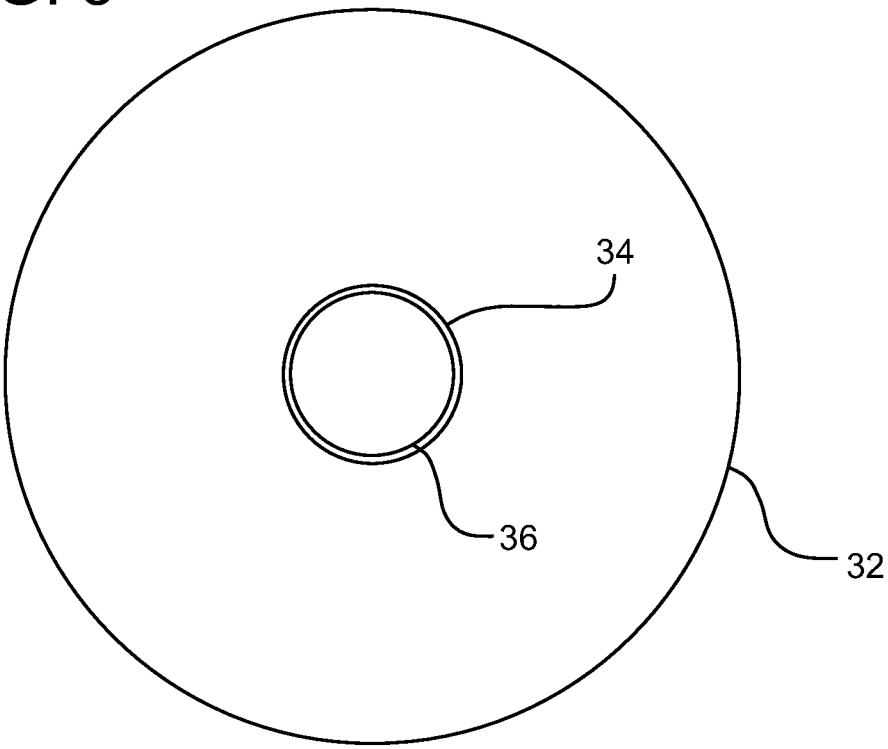
FIG. 3 illustrates an embodiment of a second portion of hook-and-loop fastener and a second target.

The separable fastener 30 may comprise the first portion 31 and the second portion 32, as is illustrated in FIGS. 2 and 3, respectively. Each of the first portion 31 and the second portion 32 may comprise a first adhesive on a first side thereof. The first adhesive may be pressure sensitive adhesive or a non-pressure sensitive adhesive. The first adhesive may be a high-tack pressure sensitive adhesive, and may comprise an acrylic, a butyl rubber, an ethylene-vinyl acetate, a styrene copolymer, a nitrile, a silicone rubber, or a styrene-butadiene-styrene copolymer. A combination comprising at least one of the foregoing can be used. The first adhesive may further comprise a tackifier, and the tackifier may comprise a terpene resin, a phenol resin, or rosin, for example. A combination comprising at least one of the foregoing can be used. In an embodiment, the adhesive is a rubber adhesive having an operating temperature of −40° C. to 110° C., specifically about −40° C. to about 85° C., more specifically about −30° C. to about 75° C. In an embodiment, the first adhesive is a pressure sensitive adhesive, and VELCRO 0119 adhesive, or VELCRO 072 adhesive, both available from Velcro USA Inc. of Manchester, N.H. are specifically mentioned.

The separable fastener 30 may be a hook-and-loop fastener. In an embodiment, the first portion 31 may comprise a hook portion and the second portion 32 may comprise a loop portion. In another embodiment, the first portion 31 may comprise a loop portion and the second portion 32 may comprise a hook portion. The hook portion and the loop portion may be disposed on a second side of the first portion 31 and on a second side of the second portion 32, wherein the second side is opposite the first side. The hook portion may comprise a nylon hook, an aramid hook, a stainless steel hook, or a polyester hook. A combination comprising at least one of the foregoing can be used. The loop portion may comprise a napped nylon loop, an unnapped nylon loop, a polyester loop, an aramid loop, or a stainless steel loop. A combination comprising at least one of the foregoing can be used. VELCRO HTH705 hook and VELCRO Loop 1000, available from Velcro USA Inc. of Manchester, N.H. are specifically mentioned.

Alternatively, each of the first portion 31 and the second portion 32 may comprise a second adhesive on the second side thereof, wherein the second side is opposite the first side. The second adhesive may be a low-tack pressure sensitive adhesive, such as a repositionable adhesive. The second adhesive may be different from the first adhesive, and may comprise a styrene-ethylene-butylene-styrene or styrene-ethylene-propylene, for example.

The first portion and the second portion may each independently have a diameter of 0.01 to 1 meter (m), specifically 0.02 to 0.5 m, more specifically 0.04 to 0.4 m, or 0.06 to 0.2 m. In an embodiment the first portion and the second portion each have a diameter of 0.1 m.

The first portion and the second portion may define the first opening 33 and the second opening 34, respectively, in a center thereof. The first opening 33 and the second opening 34 may each independently have a diameter of 0.01 to 0.1 m, specifically 0.02 to 0.09 m, more specifically 0.03 to 0.08 m. In an embodiment, the first opening 33 and the second opening 34 each have a diameter of 0.02 m.

In an embodiment, the second portion 32 is disposed on a side of the float 20 which comprises the valve.

The ice-compensating cover may further comprise a first target 35, a second target 36, or a combination thereof. The first target 35 and the second target 36 are illustrated in FIGS. 2 and 3, respectively. The first target 35 and the second target 36 may each independently comprise a pressure sensitive adhesive disk or an ink marking, for example. In an embodiment, the first target 35 and the second target 36 are each a portion of a hook-and-loop fastener. In an embodiment, the first target 35 is a hook portion of the hook-and-loop fastener, and the second target 36 is a loop portion of the hook-and-loop fastener. In another embodiment, the first target 35 is the loop portion of the hook-and-loop fastener, and the second target 36 is the hook portion of the hook-and-loop fastener. The hook-and-loop fastener may be the same type of hook-and-loop fastener disclosed above in conjunction with the separable fastener 30, and thus the foregoing description is not repeated. A hook-and-loop fastener comprising a VELCRO HTH705 hook, a Loop 1000, and pressure sensitive adhesive 0119, available from Velcro USA Inc. of Manchester, N.H. is specifically mentioned. The first target 35 and the second target 36 may each independently have a diameter of 0.001 to 0.1 m, specifically 0.01 to 0.08 m, more specifically 0.02 to 0.06 m. In an embodiment, the first target 35 and the second target 36 each have a diameter of 0.02 m.

The first target 35 and the second target 36 may each independently be disposed on a center of the cover or on a center of the float. In an embodiment, the first target 35 is disposed on a center of the cover and the second target 36 is disposed on a center of the float. The first target 35 may be vertically aligned with the center of the first opening 33, and the second target 36 may be vertically aligned with the center of the second opening 34. In an embodiment, the first target 35, the first opening 33, the second target 36, and the second opening 34 are vertically aligned.

The ice-compensating cover may further optionally include a tie 40, which fastens an edge of the cover 10 to a pool sidewall 60. The tie 40 may be a cable tie, a hook-and-loop fastener, or a snap, for example, and may be disposed through a grommet of the cover 10. A combination comprising at least one of the foregoing can be used.

Figure 4:
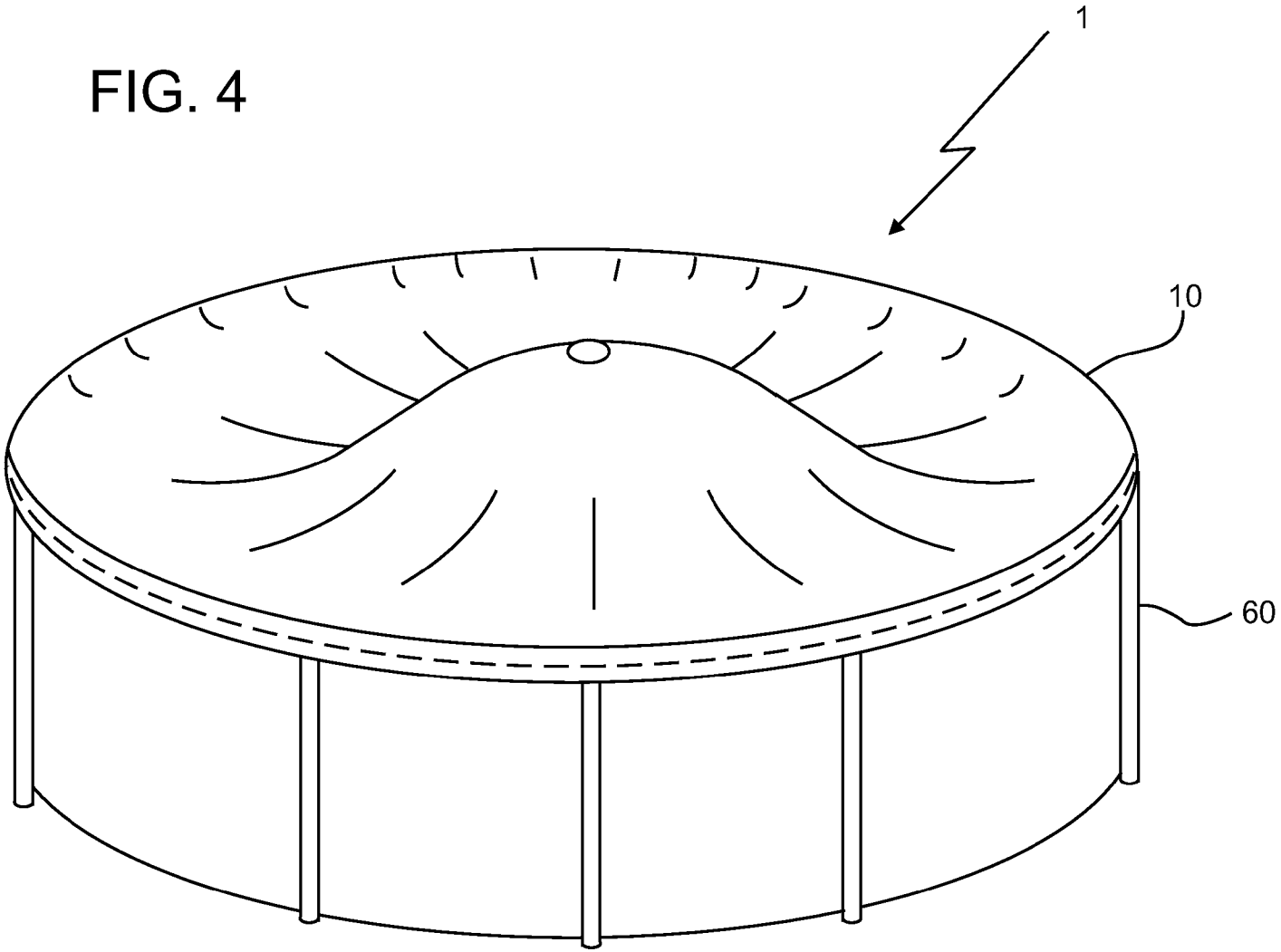
FIG. 4 illustrates an embodiment of the ice-compensating cover on a pool.

The ice-compensating cover 1 may be disposed on a pool, as illustrated in FIG. 4.

In an embodiment, the ice-compensating cover does not include a cord, a rope, or a tie contacting the float.

A method of manufacturing the ice-compensating cover 1 comprises disposing the first target 35 on a center of the cover 10; adhering the first portion 31 of the separable fastener on the cover, wherein a center of the first portion 31 of the separable fastener is aligned with a center of the first target 35; adhering the second portion 32 of the separable fastener 30 on a center of the float 20; and contacting the first portion 31 and the second portion 32 to integrate the first portion and the second portion to manufacture the ice-compensating pool cover.

The method may further comprise disposing a second target 36 on a center of the float 20, and aligning a center of the second target 36 with a center of the second portion 32. In an embodiment, the method may include aligning the center of the first target 35 with the center of the first opening 33 of the first portion 31. Also, the method may include aligning the center of the second target 36 with the center of the second opening 34. In an embodiment, the method may include aligning the center of each of the first target 35, the second target 36, the first opening 33, and the second opening 34.

In an embodiment, the first portion 31 and the first target 35 may be provided as a single piece which is scored or kiss-cut. The method may include separating the first portion 31 from the first target 35. Similarly, the second portion 32 and the second target 36 may be provide as a single piece which is scored or kiss-cut, and the method may include separating the second portion 32 from the second target 36.

Further, the method may include cable tying the cover 10 to the pool sidewall 60, for example by disposing a cable tie on the cover 10 and the pool sidewall 60.

In an embodiment, a method of manufacturing the ice-compensating cover may include laying out a cover water-side down, folding the cover in quarters to find the center of the cover, disposing a first target on the center of the cover, disposing a first portion of a hook-and-loop fastener on the first target, disposing a second target on a center of a float, disposing a second portion of the hook-and-loop fastener on the second target, and integrating the float with the cover by contacting the first portion of the hook-and-loop fastener with the second portion of the hook-and-loop fastener to manufacture the ice-compensating cover. The method may further optionally include disposing the ice-compensating cover on a pool.

If an inflatable float is used, the float may be inflated before or after the ice-compensating cover is disposed on the pool. In an embodiment, the float is inflated before the ice-compensating cover is disposed on the pool.

EXAMPLES

Examples 1-4

Vinyl air pillows (Leslie 72075, heavy gauge vinyl, 48"× 60"), each having the dimensions 4 feet by 5 feet, were each integrated with a pool cover (Leslie Pool Steel Shield Above Ground 18' Round Cover Interlocking Poly Weave with UV Chemical Inhibitors) with a VELCRO hook-and-loop fastener from Velcro USA Inc. of Manchester, N.H. to provide ice-compensating covers. The VELCRO comprised a HTH705 hook, Loop 1000, and 0119 pressure sensitive adhesive. Four shapes of hook-and-loop fastener were used, as indicated in Table 1, and the ice-compensating covers were deployed on an above ground pool in windy conditions for evaluation. The wind performance of the ice-compensating covers of Examples 1 to 4 was determined by assessment of their stability in wind. As shown in Table 1, the hook-and-loop fastener having the round shape surprising provided the best wind performance.

TABLE 1

| Example | Hook-and-loop fastener shape | Dimensions | Wind Performance |
|---|---|---|---|
| Example 1 | Square | | Good |
| Example 2 | Rectangle | | Worst |
| Example 3 | Triangle | | Good |
| Example 4 | Round | | Best |

Examples 5-8

Vinyl air pillows (Leslie 72075, heavy gauge vinyl, 48"× 60"), each having the dimensions 4 feet by 5 feet, were each integrated a pool cover (Leslie Pool Steel Shield Above Ground 18' Round Cover Interlocking Poly Weave with UV Chemical Inhibitors) with a VELCRO hook-and-loop fastener from Velcro USA Inc. of Manchester, N.H. to provide ice-compensating covers. The VELCRO comprised a HTH705 hook, Loop 1000, and 0119 pressure sensitive adhesive. Three diameters of round hook-and-loop fasteners were used, as indicated in Table 1, and the ice-compensating covers were deployed on an above ground pool in windy conditions for evaluation. The wind performance of the ice-compensating covers of Examples 5 to 7 was determined by assessment of their stability in wind. As shown in Table 2, the hook-and-loop fasteners of Examples 5-7 each provided good wind performance.

TABLE 2

| Example | Hook-and-loop fastener diameter | Wind Performance |
|---|---|---|
| Example 5 | 3 inches | Pass |
| Example 6 | 4 inches | Pass |
| Example 7 | 4.75 inches | Pass |
| Example 8 | 5.75 inches | Pass |

Examples 9-13

Example 7 was repeated except that different hook and loop combinations were evaluated at 70 F to 30 F, as provided in Table 3. In each of Examples 9-13, the adhesive was VELCRO 0119 hot melt rubber and the cure time was 15 minutes.

TABLE 3

| Example | Hook or Loop | 70 F. | 60 F. | 50 F. | 45 F. | 40 F. | 35 F. | 30 F. |
|---|---|---|---|---|---|---|---|---|
| 9 | 65 | D | D | D | D | D | D | D |
| 10 | 88 | P | P | P | P | C | C | C |
| 11 | 705 | P | P | P | P | C | C | C |
| 12 | 4000 | P | P | P | P | P | P | P |
| 13 | 1000 | P | P | P | P | P | P | P |

In Table 3, 65 refers to VELCRO Light Grade Hook 65, 88 refers to VELCRO Medium Grade Hook 88, 705 refers to Heavy Grade Hook 705, 4000 refers to VELCRO Light Grade Loop 4000, 1000 refers to VELCRO Heavy Grade Loop 1000, D refers to failure by separation between the hook and loop, C refers to failure by separation between the adhesive and the cover, and P refers to "Pass", i.e., not separation.

Examples 14-16

Example 7 was repeated except that different hook and loop combinations were evaluated at 70 F to 30 F as is provided in Table 4. In each of Examples 14-16, the adhesive was VELCRO 072 Acrylic and the cure time was 15 minutes.

TABLE 4

| Example | Hook or Loop | 70 F. | 60 F. | 50 F. | 45 F. | 40 F. | 35 F. | 30 F. |
|---|---|---|---|---|---|---|---|---|
| 14 | 88 | P | P | P | P | C | C | C |
| 15 | 705 | P | P | P | P | C | C | C |
| 16 | 1000 | P | P | P | P | P | P | P |

In Table 4, 88 refers to VELCRO Medium grade hook 88, 705 refers to VELCRO Heavy Grade Hook 705, and 1000 refers to VELCRO Heavy Grade Loop 1000.

While this disclosure describes representative embodiments, it will be understood by those skilled in the art that various changes can be made and equivalents can be substituted for elements thereof without departing from the scope of the disclosed embodiments. In addition, many modifications can be made to adapt a particular situation or material to the teachings of this disclosure without departing from the scope thereof. Therefore, it is intended that this disclosure not be limited to the particular embodiments disclosed as the best mode contemplated for carrying out this disclosure.

What is claimed is:

1. An ice-compensating cover comprising:

a cover having an inner surface and an opposite outer surface;

a first target disposed on the inner surface of the cover and on a center of the cover, wherein the first target comprises a pressure sensitive adhesive disk and wherein the inner surface of the cover is proximate to a float; and a separable fastener interposed between the cover and the float, the separable fastener comprising a first portion attached to the cover, and a second portion attached to the float, wherein the first portion of the separable fastener defines a first opening in a center of the first portion of the separable fastener, and wherein the target is aligned with the first opening.

2. The ice-compensating cover of claim 1, wherein the separable fastener is a hook-and-loop fastener.

3. The ice-compensating cover of claim 2, wherein the first portion and the second portion of the hook-and-loop fastener each comprise a rubber adhesive or an acrylic adhesive.

4. The ice-compensating cover of claim 2, wherein the first portion of the hook-and-loop fastener comprises a napped nylon loop and the second portion of the hook-and-loop fastener comprises a hook.

5. The ice-compensating cover of claim 1, wherein the opening has a diameter of 1 millimeter to 10 centimeters.

6. The ice-compensating cover of claim 2, wherein the first portion and the second portion of the hook-and-loop fastener are each circular.

7. The ice-compensating cover of claim 1, wherein a center of the first target is aligned with a center of an opening of the second portion of the separable fastener.

8. The ice-compensating cover of claim 1, further comprising a second target disposed on a center of the float.

9. The ice-compensating cover of claim 8, wherein a center of the second target is aligned with a center of the opening of the at least one of the first portion and the second portion of the separable fastener.

10. The ice-compensating cover of claim 1, further comprising a second opening in the second portion of the separable fastener.

11. An ice-compensating cover kit comprising:

a cover having an inner surface and an opposite outer surface;

a float;

a separable fastener, the separable fastener comprising a first portion having an adhesive backing, and a second portion having an adhesive backing, wherein the first portion of the separable fastener defines a first opening in a center of the first portion, wherein the second portion of the separable fastener defines a second opening in a center of the second portion; and a first target disposed in the first opening, wherein the first target comprises a pressure sensitive adhesive disk, and wherein the first target is disposed on the inner surface of the cover.

12. The ice-compensating cover kit of claim 11, further comprising a second target disposed in the second opening.

* * * * *